United States Patent [19]

Molay

[11] 4,052,561

[45] Oct. 4, 1977

[54] LECTERN WITH DETENT-HINGED SHELF FOR PORTABLE SOUND SYSTEM

[75] Inventor: Ira Molay, Wenham, Mass.

[73] Assignee: Audiophonics Corporation, Beverly, Mass.

[21] Appl. No.: 673,663

[22] Filed: Apr. 5, 1976

[51] Int. Cl.[2] ..... H04R 27/00

[52] U.S. Cl. ..... 179/1 AT; 16/132

[58] Field of Search ..... 179/1 AT, 1 E, 1 DM, 179/1 MG, 1 R, 146 R, 149, 147, 148 F; 16/132

[56] References Cited

U.S. PATENT DOCUMENTS

| | | | |
|---|---|---|---|
| 3,023,274 | 2/1962 | Shaw | 179/1 AT |
| 3,443,031 | 5/1969 | Bolick | 179/1 AT |
| 3,684,831 | 8/1972 | Fullmer | 179/1 AT |

*Primary Examiner*—Kathleen H. Claffy
*Assistant Examiner*—E. S. Kemeny
*Attorney, Agent, or Firm*—Wolf, Greenfield & Sacks

[57] ABSTRACT

A self-contained sound system that may be either battery operated or operated from an AC source and that is contained in an attache-type case which is easily handled by one person. A folder for papers is disposed in the housing along with all of the electronic circuitry including a speaker and amplifier. A lectern within the housing can be folded into the case when not in use or can be moved to a useable position when the case is open. A detachable microphone stand can be fastened to the outside of the case and is stored in the case when not in use.

9 Claims, 5 Drawing Figures

80
84
86
82
26
16
10
42
44
47
46
40
18
20
66
30
28
60
22
12
14
64
24
81
17
32
36
85

88
86
38
42
44
47
46
3
40
MIC.
AUX.
POWER
VOL.
TAPE IN
EXT. SPKR.
12V.
POWER PACK
18
20
68
72
60
30
22
24
32
64
17
36

LECTERN WITH DETENT-HINGED SHELF FOR PORTABLE SOUND SYSTEM

BACKGROUND OF THE INVENTION

The present invention relates in general to a sound system or sound apparatus and is more particularly concerned with a self-contained portable sound apparatus that can be powered by either batteries or from an AC source.

Existing public address systems are generally not of the portable type but are designed for use in a particular facility. Known sound systems generally incorporate a number of different items. For example, it is necessary to have a separate lecturn and one or more types of stands for holding the microphone. Thus, the overall system becomes quite complicated and cumbersome and if one wishes to use the system in a different facility, all of the different components of the system must be moved.

Accordingly, one object of the present invention is to provide a self-contained portable sound system. This sound system preferably can be easily carried in an attache-type case and incorporates a lectern and stand for the microphone.

Another object of the present invention is to provide a sound system or sound apparatus which is totally contained within a carrying case. This system can be either battery operated or operated from an AC source and all of the electronics including the speaker and amplifiers are contained within the carrying case.

A further object of the present invention is to provide a sound system contained in a carrying case wherein the carrying case also includes a folder for containing papers and the like. This case can be easily handled by a person and may be used as a personal public address system for use by lecturers, teachers, entertainers, salesmen, public officials, and others. This system can be used at meetings, conventions, banquets, ralleys, in class rooms, on tours, at athletic events, and other types of gatherings.

Another object of the present invention is to provide a high fidelity public address system which can be set up in seconds for use either in-doors or out-of-doors.

A further object of the present invention is to provide a sound system contained in a carrying case and including a lectern that may be folded into the case when not in use but that can be folded to a tilted position when the case is open. In this way the system can be used on a table by opening the case and tilting the lectern.

SUMMARY OF THE INVENTION

To accomplish the foregoing and other objects of this invention, there is provided a portable sound system which comprises a case that can be opened and includes means for carrying the case. The case is preferably in the form of an attache case having a carrying handle and one or more clasps for maintaining the case in a closed position. A panel is disposed in the case preferably in a fixed position. Behind the panel is disposed the electronic circuitry associated with the system. This circuitry includes an amplifier circuit, a speaker coupled from the amplifier circuit and means for powering the amplifier circuit. The means for powering the circuit may be a plurality of batteries that are disposed in the case or a cord can be provided for connection to an AC outlet. The panel may have means mounted thereon for receiving a microphone cord receiving an input from some other equipment such as a tape recorder. A volume control knob is preferably on the panel and has connections to the amplifier for controlling the output volume to the speaker.

The case preferably has at least one opening through a wall thereof and the speaker is positioned in the case in a position to project the sound through the opening. Preferably, the speaker is contained in the same area as the electronic circuitry and is mounted internally to a wall of the case with the cone of the speaker directed toward the opening in the case.

When the case is opened there is preferably provided a flat plate forming at least part of a lectern. This lectern is supported from the panel in one of two alternate positions. The lectern can be folded into the case when the case is going to be closed or the plate can be tilted to a locked position thereby forming the lectern for accommodating papers or other material.

When the party delivering the lecture has opened the case and placed the speach or notes on the lecturn the microphone is plugged into the panel in the appropriate connector and the system is ready for use. It is desirable, however, to have a support for the microphone so that the party delivering the lecture has both hands free. In accordance with this invention a microphone support is used. This support is preferably detachable and can be carried in the case. When it is desirable to support the microphone the support is suitably secured to a surface of the case so the microphone can be supported in the desired position. This support for the microphone may include an adjustable member so that the microphone is readily supported in any one of a number of different positions.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
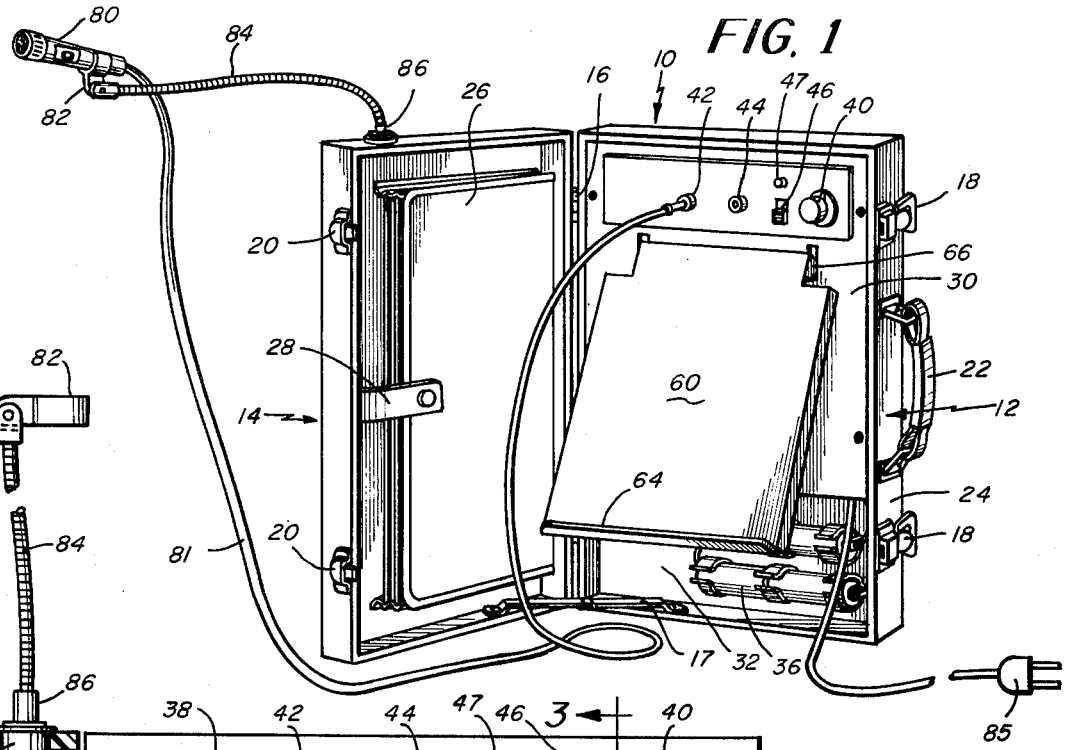
FIG. 1 is a perspective view showing the system of the present invention as embodied in a portable carrying case.
Figure 2:
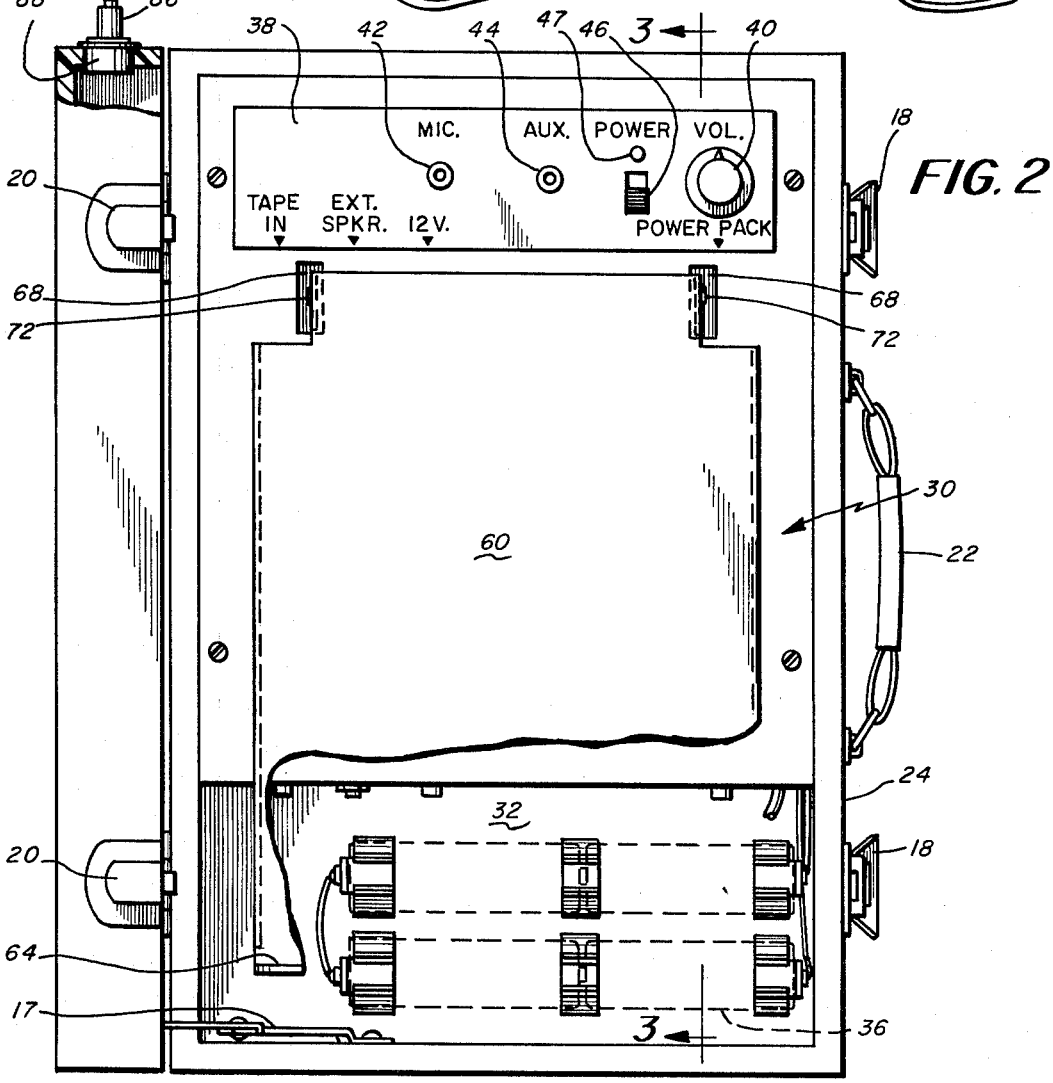
FIG. 2 is a partially cut-a-way front view of the apparatus shown in FIG. 1 with the case open.

FIG. 1 shows a portable public address system which comprises a case 10. In FIG. 1 the case is shown in its upright position. This case is an attache-type case having a main part 12 and a cover part 14. The two parts of the case are interconnected by means of conventional hinges 16. The two parts are held together in a closed position by means of conventional clasps 18 which are secured about posts 20. A handle 22 is provided extending from surface 24. Each of the parts 12 and 14 are defined by a plurality of walls and when the two parts are secured together by closing the case, then a completely enclosed case is formed. In addition to the hinges 16 there is also provided a stop bar 17 which limits the open position of the two parts comprising the case. This stop bar 17 is of conventional design, pivots at its midpoint and is attached at either end to the respective case parts 12 and 14.

Within the cover part 14 there is disposed a folder 26 which may be an accordion folder. One side of this folder may be glued or suitably affixed into the part 14 in a suitable manner. A strap 28 can be used to close the folder 26. Some type of a snap is provided on the strap 28 for mating with an accommodating snap on the folder 26. The folder 26 is for accommodating papers or other materials that the lecturer is going to use.

Figure 3:
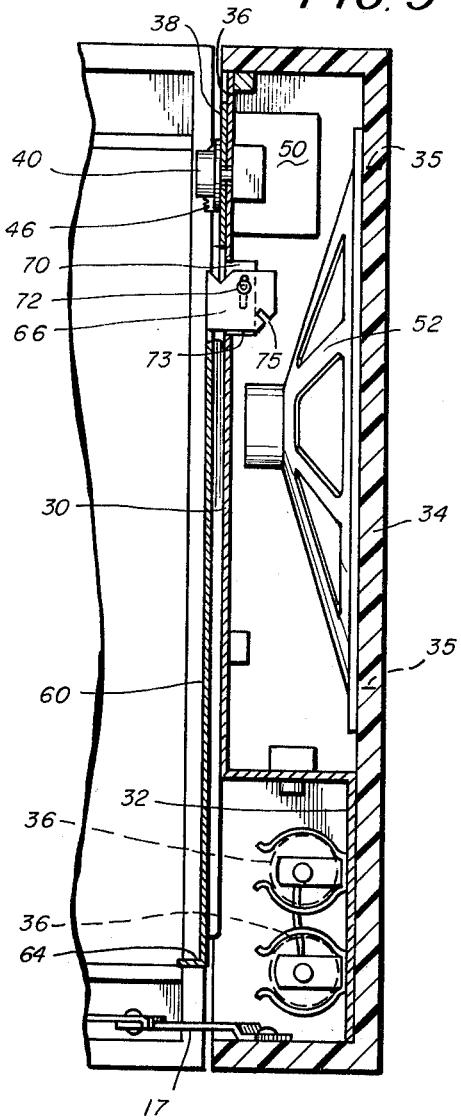
FIG. 3 is a cross-sectional view taken along line 3—3 of FIG. 2.

A panel 30 is suitably secured within the part 12 of the case. The panel 30 may be suitably secured at its bottom end 32 to the rear wall 34 of the case as indicated in FIG. 3. The stepped bottom end 32 provides a space within which the batteries 36 may be disposed. The batteries are one source with which the electronic circuitry of the system is operated. At the top of the panel 30 there is disposed a support plate 38 on which certain nomenclature is disposed. This plate 38 along with the panel 30 carries a plurality of different connectors and the volume control knob 40. The plate 38 carries a microphone connector 42, an auxiliary connector 44 and a power on-off switch 46 and associated indicator light 47. The auxiliary connector 44 may be used for connecting a phonograph or tape recorder to the amplifier circuit shown in FIG. 5. The electronic circuitry is also preferably supported from the panel 30 and is schematically shown in FIG. 3 as electrical box 50 which contains some of the components shown in FIG. 5. Box 50 basically comprises an amplifier and connections are made from the box 50 to both the speaker 52 and the batteries 36. The speaker 52 may be of conventional design and is suitably supported against the rear wall 34. The cone of the speaker over laps the opening 35 so that the sound from the speaker can be projected out of the case and toward the listening audience.

The apparatus shown in FIG. 1 when the case is opened, is provided with a plate 60 which forms a lectern. The plate 60 includes side support ribs 62 and a bottom edge flange 64. The edge flange 64 permits the plate 60 to be used as a lectern with papers being held on the plate 60 by means of this edge 64. A pair of wings 66 are integrally formed with the plate 60 and extend orthorgonally to the flap surface of the plate. These wings 66 are accommodated by rectangular holes 68 in the panel 30. The holes 68 may be punched out along three sides forming a tab 70 which is folded back so that the tab 70 is orthorgonal to the panel 30. A pin or rivet or the like 72 extends through each wing 66 and also through the elongated slots 74 formed in the tabs 70. The pivot pin 72 acts as a pivot point and by providing an elongated slot the plate 60 may be moved slightly up and down as it is rotated.

Figure 4:
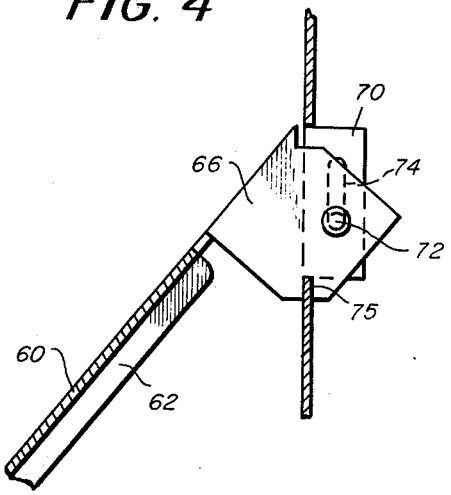
FIG. 4 is a partial cross-sectional view showing a portion of the structure indicated in FIGS. 2 and 3.

In the position shown in FIG. 3, the plate 60 is not in use and it is noted that the pin 72 is moved slightly upward in the slot 74 with the edge 73 of the wing 66 resting upon the bottom edge of the hole 68. In order to move the plate 60 to the position shown in FIG. 4, the plate 60 is raised slightly and then rotated outwardly until the notch 75 in each of the wings 66 engages with the edge defined by the hole 68. In this way the lectern is locked in this tilted position until the plate 60 is again raised so that the notch 75 disengages from the edge defined by the hole 68.

When the system of this invention is in use it is preferably disposed in the position shown in FIG. 1. The microphone 80 is attached by means of the cord 81 to the connector 42. When they hold the microphone in their hand and with a sufficient length of cord, one can walk a substantial distance from the case 10 speaking into the microphone. On the other hand, if one is lecturing and using the lectern for notes then it is desirable that the microphone 80 be held in the position shown in FIG. 1 by means of the microphone holder 82. This holder 82 is disposed at one end of a flexible cable 84. The other end of the cable 84 has a screw end 86 which is received by cylindrical member 88. The end 86 is screwed into cylindrical member 88 and with the use of a flexible cable 84 the microphone can be oriented in many different positions. When the lecturer is through with the system, then the microphone support can be unscrewed from the cylindrical member 88. The microphone holder can then be housed in a suitable position within the case 10, such as within the folder 26.

Figure 5:
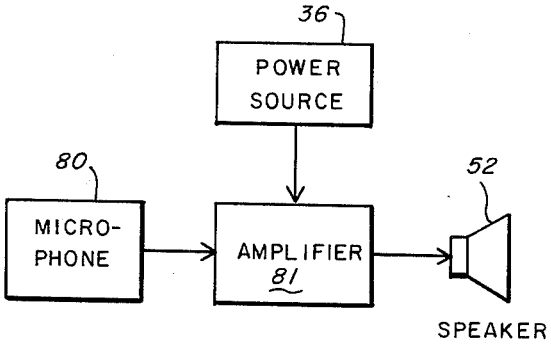
FIG. 5 is a schematic block diagram associated with the electronics of this system.

FIG. 5 simply shows a schematic block diagram showing the interconnections between some of the electronic components of the system. The microphone 80 obviously interconnects to the amplifier circuit 81. The amplifier circuit 81 is contained in the electronic box 50 shown in FIG. 3. The amplifier is powered from a power source 36 which may be the batteries or power can be provided by way of an AC plug 85 as shown in FIG. 1. The output from the amplifier may be controlled by means of the volume control knob 40 and this output couples to the speaker 52 which is probably most clearly shown in FIG. 3 of the drawings.

Having described one embodiment for the system of this invention, it should now be apparent to those skilled in the art that numerous other embodiments and modifications of the one shown herein are contemplated as falling within the scope of the present invention.

What is claimed is:

1. For a portable sound system having a carrying case and circuit means disposed in the carrying case including an amplifier circuit and speaker, the improvement comprising; plate means forming at least part of a lectern having a lower edge flange permitting papers or the like to be held on the plate means when the plate means is in a tilted position, a panel fixedly mounted in the carrying case, and means for supporting the plate means in the case in either of two positions, said plate supporting means comprising tabs extending from the panel and pivot pins engagable with slots in the tabs, said plate means having on opposite sides at its top end extensions passing through respective holes in the panel with the pivot pins also engaging with the extensions.

2. A sound system as set forth in claim 1 wherein each extension has a notch for engaging with an edge defined by the hole in the panel for supporting the plate in its tilted position, said slots being elongated for permitting the plate to lock in the tilted position.

3. A sound system as set forth in claim 2 wherein the extensions are disposed orthogonally to the flat plate and the tabs are disposed orthogonally to the panel.

4. For a portable sound system having a carrying case, electronic circuit and speaker means contained in the carrying case, and means within the carrying case for receiving a microphone, the improvement comprising; plate means forming at least part of a lectern having a lower edge flange permitting papers or the like to be held on the plate means when the plate means is in one tilted position of at least two different positions, a panel fixedly mounted in the carrying case, pivot means mounted from the panel for pivotally supporting the top end of the plate means in two positions including a rest position wherein the plate means lies adjacent to and substantially parallel to the panel, and detent means associated with the plate means for locking the plate means in a tilted position.

5. A sound system as set forth in claim 4 wherein said pivot means comprises a pair of pivot pins disposed respectively at opposite sides of the plate means.

6. A sound system as set forth in claim 5 wherein said plate means has a pair of wings extending from the plane of the plate means each having a notch defining at least in part the detent means.

7. A sound system as set forth in claim 6 wherein said panel has a pair of spaced holes for accommodating respective wings and having tabs extending from the edge of each hole, each tab having a slot for receiving the pivot pin.

8. A sound system as set forth in claim 7 wherein each notch in the wing is for engaging with an edge defined by the hole in the panel to support the plate means in the tilted position.

9. A sound system as set forth in claim 4 wherein said detent means comprise a pair of wings extending from the top respective opposite sides of the plate means, said wings for receiving said pivot means and each having a notch defining a detent for engaging with an edge of the panel.

* * * * *